US006994428B2

(12) United States Patent
Ito

(10) Patent No.: US 6,994,428 B2
(45) Date of Patent: Feb. 7, 2006

(54) INK-JET PRINTING HEAD HAVING A PLURALITY OF ACTUATOR UNITS AND/OR A PLURALITY OF MANIFOLD CHAMBERS

(75) Inventor: Atsushi Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 27 days.

(21) Appl. No.: 10/440,309

(22) Filed: May 19, 2003

(65) Prior Publication Data

US 2003/0218659 A1 Nov. 27, 2003

(30) Foreign Application Priority Data

May 21, 2002 (JP) ..... 2002-145654
May 21, 2002 (JP) ..... 2002-145655

(51) Int. Cl.
*B41J 2/045* (2006.01)

(52) U.S. Cl. ..... 347/71; 347/68

(58) Field of Classification Search ..... 347/71, 347/68, 70

See application file for complete search history.

(56) References Cited

U.S. PATENT DOCUMENTS

| | | | | |
|---|---|---|---|---|
| 4,680,595 A | | 7/1987 | Cruz-Uribe et al. | 347/70 |
| 5,087,930 A | | 2/1992 | Roy et al. | 347/71 |
| 5,677,718 A | | 10/1997 | Crawford et al. | |
| 5,896,154 A | | 4/1999 | Mitani et al. | |
| 6,003,971 A | * | 12/1999 | Hanks et al. | 347/43 |
| 6,079,820 A | | 6/2000 | Dijksman et al. | |
| 2002/0024567 A1 | | 2/2002 | Takagi | |

FOREIGN PATENT DOCUMENTS

| | | | | |
|---|---|---|---|---|
| EP | 0 755 791 A2 | | 1/1997 | |
| EP | 1 024 003 A2 | | 8/2000 | |
| EP | 1 052 097 A2 | | 11/2000 | |
| EP | 1 057 633 A1 | | 12/2000 | |
| EP | 1 136 269 A2 | | 9/2001 | |
| JP | A 6-226975 | | 8/1994 | |
| JP | A 9-226112 | | 9/1997 | |
| JP | A 2001-246748 | | 9/2001 | |
| JP | A 2002-36545 | | 2/2002 | |
| JP | 4-126257 | * | 4/2002 | 347/71 |

* cited by examiner

*Primary Examiner*—K. Feggins
*Assistant Examiner*—Julian D. Huffman
(74) *Attorney, Agent, or Firm*—Oliff & Berridge, PLC

(57) ABSTRACT

An ink-jet printing head including a cavity unit and an actuator superposed on each other, wherein the cavity unit has (a) a plurality of nozzles open in a front surface thereof and arranged in at least one row, (b) a plurality of pressure chambers corresponding to the nozzles, (c) a plurality of communication passages for communication between the respective pressure chambers and the respective nozzles, and (d) a manifold portion for storing an ink supplied from an ink supply source and re-filling the pressure chambers, and the actuator has a plurality of active portions which correspond to the respective pressure chambers and which are selectively operable to deliver the ink from the corresponding nozzles. The manifold portion or the actuator, or each of the manifold portion and the actuator consists of a plurality of divisions corresponding to respective length portions of each row of the nozzles and which are arranged in a direction substantially parallel to a direction of extension of each row of the nozzles.

12 Claims, 6 Drawing Sheets

INK-JET PRINTING HEAD HAVING A PLURALITY OF ACTUATOR UNITS AND/OR A PLURALITY OF MANIFOLD CHAMBERS

The present application is based on Japanese Patent Application No. 2002-145654 and Japanese Patent Application No. 2002-145655, both filed May 21, 2002, the contents of which are incorporated herein by reference.

BACKGROUND OF THE INVENTION

1. Field of the Invention

The present invention relates in general to an ink-jet printing head, and more particularly to the construction of a large-sized ink-jet printing head having a large number of nozzles arranged in at least one row.

2. Discussion of Related Art

A prior art ink-jet printing head of on-demand type, as disclosed in JP-A-2002-36545 and U.S. Patent Application Publication U.S. 2002/0024567 A1, for example, includes a cavity unit consisting of a plurality of plates superposed on each other so as to define ink delivery passages. These plates include a nozzle plate having a plurality of nozzles, a base plate partially defining pressure chambers corresponding to the respective nozzles, and manifold plates partially defining manifold chambers which communicate with an ink supply source and the above-indicated pressure chambers. The ink-jet printing head further includes a piezoelectric actuator which includes piezoelectric ceramic plates, and internal electrodes in the form of common electrodes and arrays of individual electrodes formed on the piezoelectric ceramic plates such that the common electrodes and the individual electrode arrays are alternately superposed on each other. The piezoelectric actuator and the cavity unit are bonded together such that active portions existing between the common electrode and the respective individual electrode are aligned with the respective pressure chambers.

In an ordinary ink-jet printer known in the art, a printing operation is performed by an ink-jet printing head in a direction of width of a recording medium such as a sheet of paper, which direction is perpendicular to a direction of feeding of the recording medium. The direction of width and the direction of feeding of the paper sheet will be respectively referred to as "primary scanning direction" and "secondary scanning direction" where appropriate. The printing operation is performed such that rows of the nozzles of the ink-jet printing head are parallel to the direction of feeding of the paper sheet (the secondary scanning direction). In this arrangement, images can be printed during each one movement of the carriage in the primary scanning direction, in the corresponding area of the paper sheet whose dimension in the secondary scanning direction is substantially equal to the length of each row of the nozzles. For example, the ink-jet printing head has a plurality of parallel rows of nozzles, each of which has a length of one inch (25.4 mm) and consists of 72 nozzles, and the nozzles in the parallel rows are arranged such that the nozzles of one row and the nozzles of the adjacent row are positioned in a zigzag pattern. In this case, the area in which a printing operation is performed on the paper sheet during one movement of the ink-jet printing head in the primary scanning direction has a dimension of one inch in the secondary scanning direction. This dimension may be referred to as "maximum printable height" per one movement of the ink-jet printing head in the primary scanning direction.

To meet recent demands for an increased printing speed and an improved quality of printed images, there has been a need for increasing the length of the rows of the nozzles to about two inches, for instance, by increasing the number of the nozzles in each row while maintaining the spacing pitch of the nozzles (dot-to-dot distance) in the secondary scanning direction.

On the other hand, each manifold chamber formed in the cavity unit, between the nozzles in the corresponding row and the ink supply source, is provided to store a suitable volume of an ink supplied from the ink supply source, and is arranged to re-fill the pressure chambers with the ink when the actuator is operated according to printing commands, to deliver the ink from the selected pressure chambers to the corresponding nozzles so that droplets of the ink are jetted from the nozzles onto the paper sheet. Where the cavity unit has a relatively large number of nozzles arranged in each row, the ratio of the volume of the corresponding manifold chamber to the entire volume of the cavity unit must be increased for the reason described below.

Namely, the length of each manifold chamber must be increased with an increase in the number of the nozzles in the corresponding row. However, a mere increase in the length of the manifold chamber in the direction of extension of the row of the nozzles will cause the following problems.

When the ink flows through the manifold chamber toward the nozzle at one end of the row of the nozzles which is furthest from the portion of the manifold chamber at which the manifold chamber communicates with the ink supply source, the rate or amount of flow of the ink tends to decrease in the direction of the flow due to a resistance to the flow of the ink mass in contact with the wall surfaces of the manifold chamber.

To prevent a decrease in the pressure of the ink mass flowing toward the ends of the manifold chamber, it is required to increase the volume of the manifold chamber to the entire volume of the cavity unit, by increasing the width dimension of the manifold chamber in the direction of width of the manifold plates (perpendicular to the direction of extension of the rows of the nozzles), so that the external dimensions of the cavity unit as viewed in the plane parallel to the manifold plates are accordingly increased, contrary to a need to reduce the size of the cavity unit.

When the ink in each pressure chamber is instantaneously pressurized upon activation of the corresponding portion of the actuator, a pressure wave of the ink in the pressure chamber includes a reverse component propagating in a direction toward the manifold chamber, as well as a forward component propagating in a direction toward the corresponding nozzle. In this respect, a change in the configuration of each manifold chamber, in particular, its longitudinal dimension, requires corresponding changes in the nominal magnitude and timing of operation of the actuator, and in the nominal waveform of the pressure wave indicated above. For instance, a cavity unit whose rows of nozzles has a length of one inch (having a comparatively small number of nozzles) and a cavity unit whose rows of nozzles have a length of two inches (having a comparatively large number of nozzles) have different nominal pressure waves of the ink in the pressure chambers, and should therefore have different designs in basic arrangements such as different magnitudes and timings of operation of the actuator, leading to problems of an increase in the required cost of development of the cavity units and an increase in the time required to complete the ink-jet printing heads as commercial products.

For increasing the length of each row of the nozzles with an increase in the number of the nozzles in each row, the nozzles and pressure chambers can be formed in the plates of the cavity unit, with the nominal spacing pitches or distances with high accuracy, irrespective of the number of the nozzles and pressure chambers, where the nozzles and pressure chambers are formed by laser machining or etching operations in those plates formed of a metallic or synthetic material.

For providing each piezoelectric ceramic plate of the piezoelectric actuator with the active portions corresponding to the respective nozzles, on the other hand, the length of the piezoelectric ceramic plate should necessarily be increased with an increase in the number of the nozzles.

As known in the art, the piezoelectric actuator is fabricated by pressing and then firing a laminar structure wherein piezoelectric ceramic plates each having the common electrode formed thereon in a predetermined pattern and piezoelectric ceramic plates each having the individual electrodes formed in a predetermined pattern are alternately superposed on each other. Generally, the dimensions of the piezoelectric ceramic plates in the directions of length, width and thickness are reduced due to shrinkage of the plates as a result of a firing operation. In particular, the amount of shrinkage of the piezoelectric ceramic plates in the direction of length (perpendicular to the direction of extension of the rows of the nozzles) is considerably large. The spacing distance between the adjacent individual electrodes in the direction of length of the piezoelectric plates is determined with the above-indicated amount of shrinkage (shrinkage ratio) taken into account.

In the presence of variations in the fabrication of the piezoelectric ceramic plates, such as variations in the dimensional accuracy and firing temperature, however, it becomes more and more difficult to match the spacing distance between the adjacent individual electrodes formed on the fired piezoelectric ceramic plates, with the spacing distance of the adjacent pressure chambers, as the length of the piezoelectric ceramic plates is increased.

SUMMARY OF THE INVENTION

It is therefore an object of the present invention to provide a relatively large-sized ink-jet printing head which has a relatively large number of nozzles and which is easy and economical to develop and manufacture.

The above object may be achieved according to the principle of this invention, which provides an ink-jet printing head including a cavity unit and an actuator which are superposed on each other, the cavity unit having (a) a plurality of nozzles open in a front surface thereof and arranged in at least one row, (b) a plurality of pressure chambers corresponding to the nozzles, respectively, (c) a plurality of communication passages for communication between the respective pressure chambers and the respective nozzles, and (d) a manifold portion for storing an ink supplied from an ink supply source and re-filling the pressure chambers when the ink is delivered from the pressure chambers to the nozzles, the actuator having a plurality of active portions which correspond to the pressure chambers, respectively and which are selectively operable to deliver the ink from the corresponding nozzles, wherein each of at least one of the manifold portion and the actuator consists of a plurality of mutually independent divisions which correspond to respective length portions of each of the above-indicated at least one row of the nozzles and which are arranged in a direction substantially parallel to a direction of extension of the at least one row of the nozzles.

Where the manifold portion consists of a plurality of divisions in the form of mutually independent manifold chambers which correspond to the respective length portions of each row of the nozzles arranged in one row or two or more rows, each of those manifold chambers may be formed so as to be identical with the manifold chamber formed in the cavity unit of an already developed or existing printing head, which manifold chamber has the same length as the plurality of manifold chambers formed in the cavity unit of the present ink-jet printing head. The present ink-jet printing head with the cavity unit having a larger number of nozzles than the existing cavity unit has the same printing capability as the existing ink-jet printing head. In other words, the provision of the plurality of manifold chambers according to the present invention permits easy and economical manufacture of a large-sized ink-jet printing head which has the same basic functions as the already developed or existing printing head. Further, the plurality of manifold chambers need not have a length so large as to cause an increase in the resistance to a flow of the ink therethrough, so that it is not necessary to increase the width of each manifold chamber, for reducing the ink flow resistance. In this respect, the cavity unit can be small-sized. Since the plurality of divisions of the manifold portion in the form of the manifold chambers are arranged in a direction substantially parallel to the direction of extension of the above-indicated at least one row of the nozzles, it is possible to reduce the surface area of the cavity unit as viewed in its plane perpendicular to the above-indicated front surface in which the nozzles are open.

Where the actuator consists of a plurality of divisions in the form of mutually independent actuator units which correspond to the respective length portions of each row of the nozzles, each of those actuator units may be formed so as to be identical with the already developed or existing actuator. The provision of the plurality of actuator units according to the present invention permits easy and economical manufacture of a large-sized ink-jet printing head, by utilizing an actuator of an already developed or existing ink-jet printing head, such that the present printing head has the same basic functions as the existing printing head and is operable with the same drive voltage and at the same timing as in the existing printing head.

According to a first preferred form of the invention, the manifold portion consists of a plurality of mutually independent manifold chambers as the above-indicated plurality of mutually independent divisions which correspond to the respective length portions of each row of the nozzles and each of which is held in communication with a group of the pressure chambers communicating with a corresponding one of the length portions of each row of the nozzles.

The ink-jet printing head has both of the advantages described above with respect to the provision of the plurality of mutually independent manifold chambers and the provision of the plurality of mutually independent actuator units.

In a second preferred form of the invention, the plurality of nozzles are arranged in a plurality of substantially parallel rows, and the plurality of mutually independent divisions of the manifold portion consist of a plurality of sets of manifold chambers which respectively correspond to the plurality of substantially parallel rows of the nozzles, each of the sets of manifold chambers consisting of a plurality of mutually independent manifold chambers which correspond to the respective length portions of each row of the nozzles. This arrangement permits reduction in the above-indicated surface area of the cavity unit, even where the ink-jet printing head is arranged to perform a full-color printing operation using the four rows of nozzles corresponding to black, cyan, yellow and magenta, for instance.

According to a third preferred form of the invention, the actuator consists of a plurality of mutually independent actuator units as the above-indicated plurality of mutually independent divisions which correspond to the respective groups of the pressure chambers corresponding to the respective length portions of each row of the nozzles.

According to a fourth preferred form of the present invention, the plurality of mutually independent divisions of the actuator consist of a plurality of actuator units which are disposed such that end faces of adjacent ones of the plurality of actuator units are opposed to each other in the direction substantially parallel to the direction of extension of the at least one row of the nozzles, and such that a distance between each of the end faces of the adjacent ones of the actuator units and one of the plurality of active portions of a corresponding one of the adjacent actuator units which is nearest to the end face in question is larger than a half of a spacing pitch of the active portions in each of the plurality of actuator units.

In the ink-jet printing head according to the fourth preferred form of the invention, the number of the nozzles arranged in each row can be easily increased while maintaining the spacing pitch of the nozzles in the existing printing head, by using the two or more actuator units which are the same as the actuator of the existing printing head and which have a length that is a fraction of the length of each row of the nozzles. Accordingly, the amount of shrinkage of each actuator unit is reduced, and the amount of variation in the spacing distance of the active portions of the actuator can be accordingly reduced. Thus, the present arrangement permits efficient and economical manufacture of the actuator with a high degree of dimensional accuracy.

In addition, the ink-jet printing head according to the fourth preferred form of the invention described above can be easily manufactured such that the length of each row of the nozzles is a multiple of the length of each actuator unit.

According to one advantageous arrangement of the above-indicated fourth preferred form of the invention, the end faces of the adjacent ones of the actuator units are spaced apart from each other.

According to a second advantageous arrangement of the above-indicated fourth preferred form of the invention, the communication passages for communication between the pressure chambers and the corresponding nozzles in the cavity unit are inclined with respect to a direction perpendicular to the front surface in which the plurality of nozzles are open.

In the above-indicated second advantageous arrangement, the plurality of actuator units may include two actuator units disposed adjacent to each other in the direction substantially parallel to the direction of extension of the at least one row of the nozzles. In this case, the communication passages include two groups of communication passages which correspond to the above-indicated two actuator units and which are formed such that the communication passages of one of the two groups and the communication passages of the other of the two groups are formed symmetrically with each other with respect to a plane perpendicular to the front surface of the cavity unit.

In the above-indicated second advantageous arrangement, the cavity unit may be a laminar structure consisting of a plurality of plates superposed one ach other, and the communication passages are inclined with respect to a direction of lamination of the plurality of plates.

According to a fifth preferred form of this invention, a spacing pitch of the plurality of active portions of the actuator and a spacing pitch of the plurality of pressure chambers are equal to a spacing pitch of the plurality of nozzles.

The spacing arrangement of the active portions, pressure chambers and nozzles in the above-indicated fourth preferred form of the invention permits the use of an already developed or existing actuator to manufacture a large-sized high-speed ink-jet printing head which has the same basic functions as an existing printing head including the existing actuator and which is operable with the same drive voltage and at the same timing as in the existing printing head.

According to a sixth preferred form of this invention, the plurality of nozzles are arranged in a plurality of rows, and the plurality of active portions of the actuator are arranged in a plurality of rows corresponding to the plurality of rows of the nozzles.

According to a seventh preferred form of the invention, the plurality of nozzles are arranged in four rows. This form of the invention provides a compact full-color ink-jet printing head.

According to an eighth preferred form of the invention, each of the plurality of mutually independent divisions of the manifold portion consists of a plurality of mutually independent manifold chambers which are provided for a corresponding one of the length portions of each row of the nozzles and which are arranged in a direction perpendicular to the direction of extension of the at least one row of the nozzles, and each of the plurality of mutually independent divisions of the actuator consists of a plurality of mutually independent actuator units which respectively correspond to the length portions of each row of the nozzle, each of the plurality of mutually independent actuator units corresponding to a plurality of rows of the pressure chambers which respectively correspond to the plurality of mutually independent manifold chambers of a corresponding one of the plurality of mutually independent divisions of the manifold portion and which are arranged in the direction perpendicular to the direction of extension of the at least one row of the nozzles.

The eighth preferred form of the invention provides a large-sized ink-jet printing head wherein the two or more rows of pressure chambers are provided for each length portion of each row of the nozzles, so that the printing head is capable of printing a high-density image, owing to a density of the nozzles in the direction of extension of their row or rows, which is a multiple of the density of the pressure chambers (and the active portions of the actuator) in the direction of extension of their rows.

According to a ninth preferred form of this invention, each of the plurality of mutually independent divisions of the manifold portion consists of a single manifold chamber which are provided for a corresponding one of the length portions of each row of the nozzles.

According to a tenth preferred form of the invention, the plurality of nozzles are arranged in a plurality of rows, and the plurality of mutually independent divisions of the manifold portion consist of a plurality of sets of manifold chambers which respectively correspond to the plurality of rows of the nozzles, each of the sets of manifold chambers consisting of a plurality of mutually independent manifold chambers which correspond to the respective length portions of a corresponding one of the rows of the nozzles and which store inks supplied from respective different ink supply sources.

According to an eleventh preferred form of this invention, the plurality of nozzles are arranged in four rows for delivering inks of four colors, such as black, cyan, magenta and yellow, respectively.

According to a twelfth preferred form of the invention, the manifold portion consists of a plurality of mutually independent elongate manifold chambers which correspond to the respective length portions of each row of the nozzles, and each of the mutually independent elongate manifold chamber extending in the direction substantially parallel to the direction of extension of the at least one row of the nozzles, and being held in communication, at one of opposite longitudinal end portions thereof, with the ink supply source.

In one advantageous arrangement of the twelfth preferred form of the invention, the plurality of mutually independent elongate manifold chambers consist of two elongate manifold chambers which correspond to respective two length portions of each row of the nozzles, each one of these two elongate manifold chambers being held in communication with the ink supply source, at one of opposite longitudinal end portions thereof which is remote from the other of the two elongate manifold chambers in the direction of extension of the two elongate manifold chambers.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENTS

Figure 1:
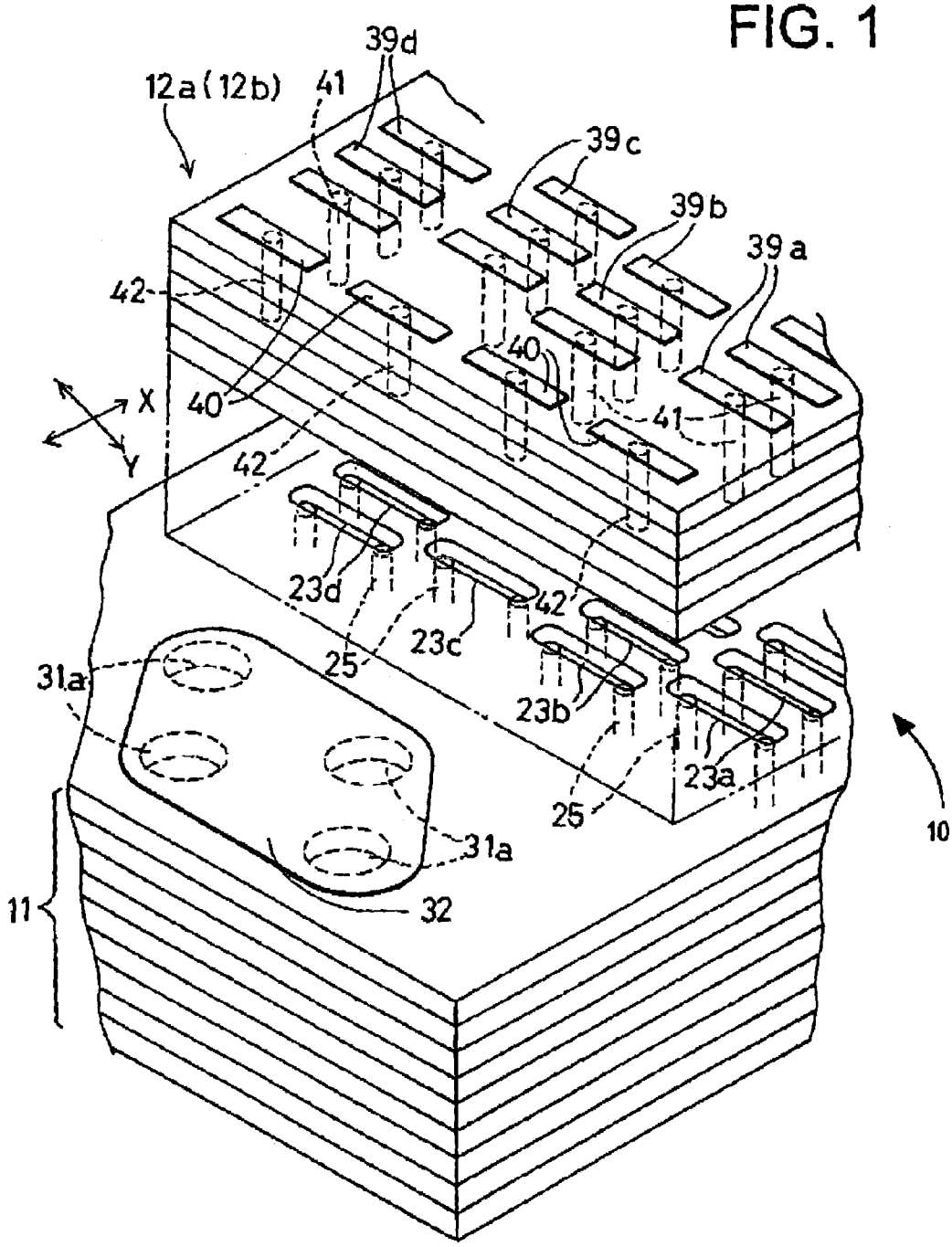
FIG. 1 is a fragmentary perspective explosive view showing a cavity unit and a piezoelectric actuator of an ink-jet printing head of piezoelectric type according to one embodiment of this invention.
Figure 5:
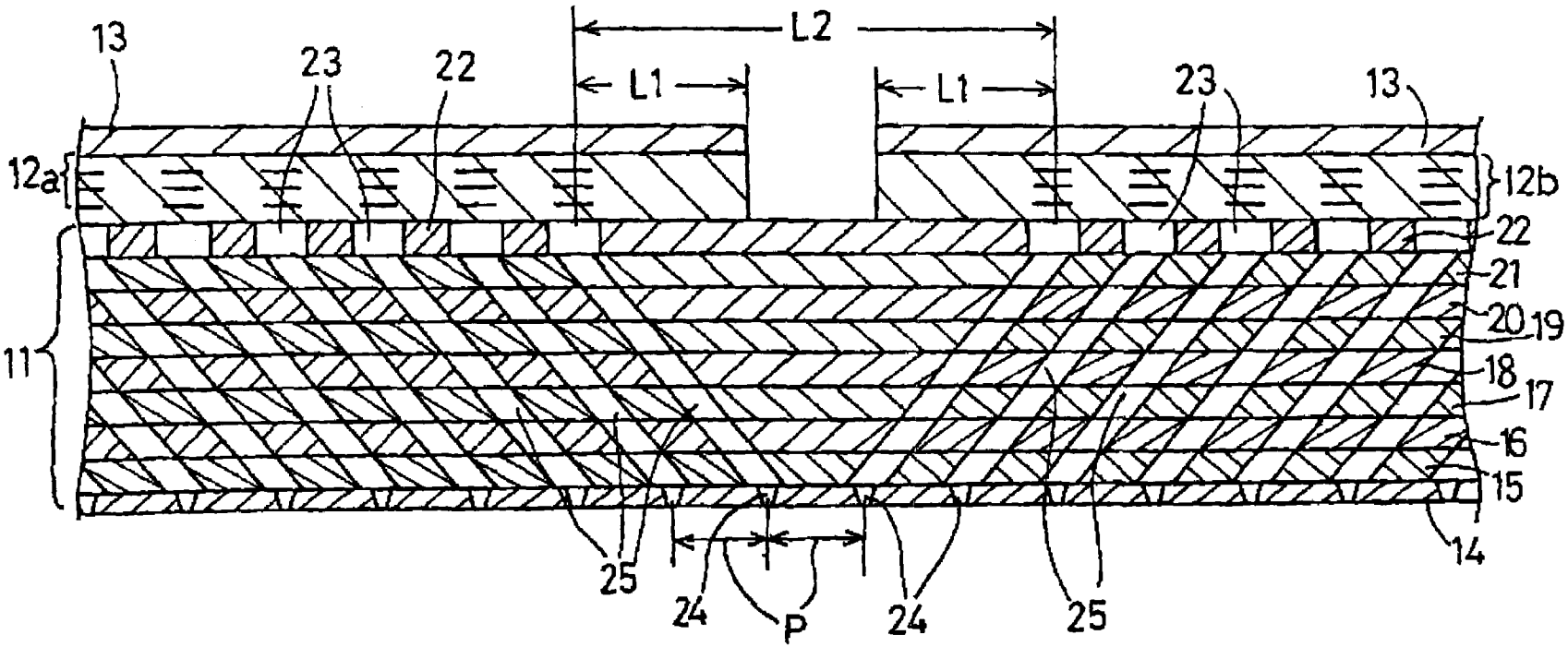
FIG. 5 is an enlarged elevational view in cross section taken in a plane parallel to an X-axis direction indicated in FIGS. 1 and 2, of an intermediate portion of the ink-jet printing head with a flexible flat cable, the cavity unit and the piezoelectric actuator being fixed thereto by bonding.
Figure 6A:
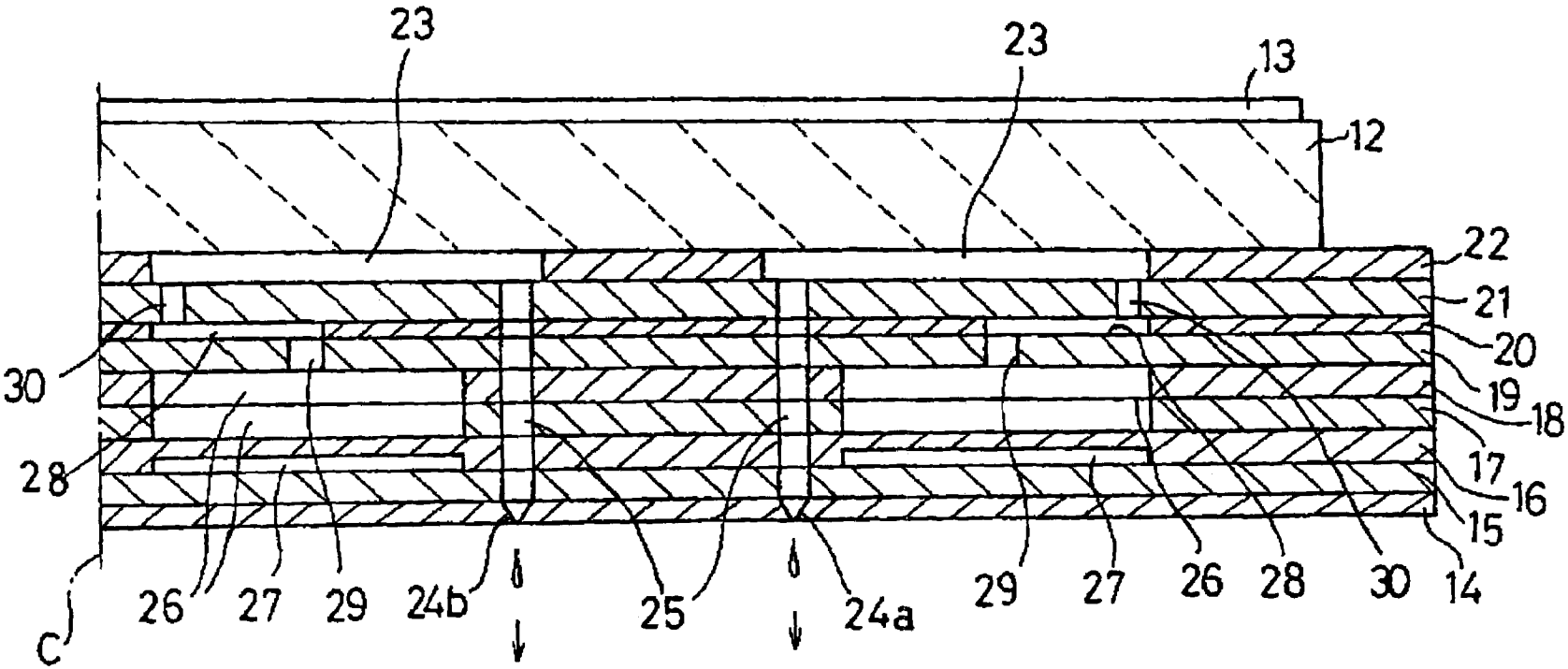
FIG. 6A is an enlarged elevational view in cross section taken in a plane parallel to a Y-axis direction indicated in FIGS. 1 and 2, of an intermediate portion of the ink-jet printing head.

Referring first to the fragmentary perspective view of FIG. 1, the ink-jet printing head 10 of piezoelectric type constructed according to one embodiment of the present invention includes a cavity unit 11 and a piezoelectric actuator 12. The piezoelectric actuator 12, which is of a planar type, is bonded to an upper surface of a metallic base plate 22 of the cavity unit 11, and a flexible flat cable 13 for connection with an external device is superposed on and bonded by an adhesive to an upper surface of the planar piezoelectric actuator 12, as shown in FIGS. 5 and 6A.

The above-indicated cavity unit 11 is constructed as shown in FIGS. 2–6. Described in detail, the cavity unit 11 is a laminar structure consisting of a total of nine relatively thin plates superposed on each other and bonded together by an adhesive. The nine thin plates consist of a nozzle plate 14, an intermediate plate 15, a damper plate 16, two manifold plates 17, 18, three spacer plates 19, 20, 21, and the above-indicated base plate 22, which has a plurality of pressure chambers 23. In the present embodiment, the nozzle plate 14 is formed of a synthetic resin, while the other plates 15–22 are formed from plates of a steel alloy including 42% of nickel and have thickness values of about 50–150 $\mu$m.

The above-indicated nozzle plate 14 has nozzles 24 which are open in a front surface of the cavity unit 11 and each of which has an extremely small diameter (about 25 $\mu$m in this embodiment). The nozzles 24 are arranged in four parallel rows formed so as to extend in a first direction of the nozzle plate 14 (in the longitudinal direction of the cavity unit 11, which is an X-axis direction indicated in FIGS. 1 and 2), such that the nozzles 24*a* and 24*b* in the respective two adjacent rows are arranged in a zigzag pattern, while the nozzles 24*c* and 24*d* in the respective two other adjacent rows are also arranged in a zigzag pattern.

That is, the multiple nozzles 24*a* in the first row and the multiple nozzles 24*b* in the second row are arranged at a predetermined small pitch P along respective two parallel reference lines (not shown) extending in the above-indicated first direction, such that each of the nozzles 24*a* is positioned in between the adjacent nozzles 24*b* in the direction of extension of the reference lines, whereby the nozzles 24*a* and the nozzles 24*b* are arranged in a zigzag pattern or in a staggered fashion. Similarly, the multiple nozzles 24*c* in the third row and the multiple nozzles 24*d* in the fourth row are arranged at the predetermined small pitch P along respective two parallel reference lines extending in the first direction, such that each of the nozzles 24*c* is positioned in between the adjacent nozzles 24*d*, whereby the nozzles 24*c* and the nozzles 24*d* are arranged in the zigzag pattern or staggered fashion. A set consisting of the first and second rows of the nozzles 24*a*, 24*b* is spaced by a suitable distance from a set consisting of the third and fourth rows of the nozzles 24*c*, 24*d*, in a second direction of the nozzle plate 24 (in the transverse or width direction of the cavity unit 11, which is a Y-direction direction also indicated in FIGS. 1 and 2). In the present specific example, each of the first, second, third and fourth rows has a length of two inches, and consists of a total of 150 nozzles 24, so that the present ink-jet printing head 10 has an image resolution of 75 dpi (dots per inch) in the first or X-axis direction, with the 75 nozzles 24 existing per inch.

There will next be described a positional relationship of the pressure chambers 23 formed in the uppermost base plate 22 of the cavity unit 11, relative to active portions of two actuator units 12*a*, 12*b* of the piezoelectric actuator 12 which are disposed on the base plate 22 such that the two actuator units 12*a*, 12*b* are arranged or spaced apart from each other in the direction of extension of the rows of the nozzles 24 (in the first direction).

Figure 2:
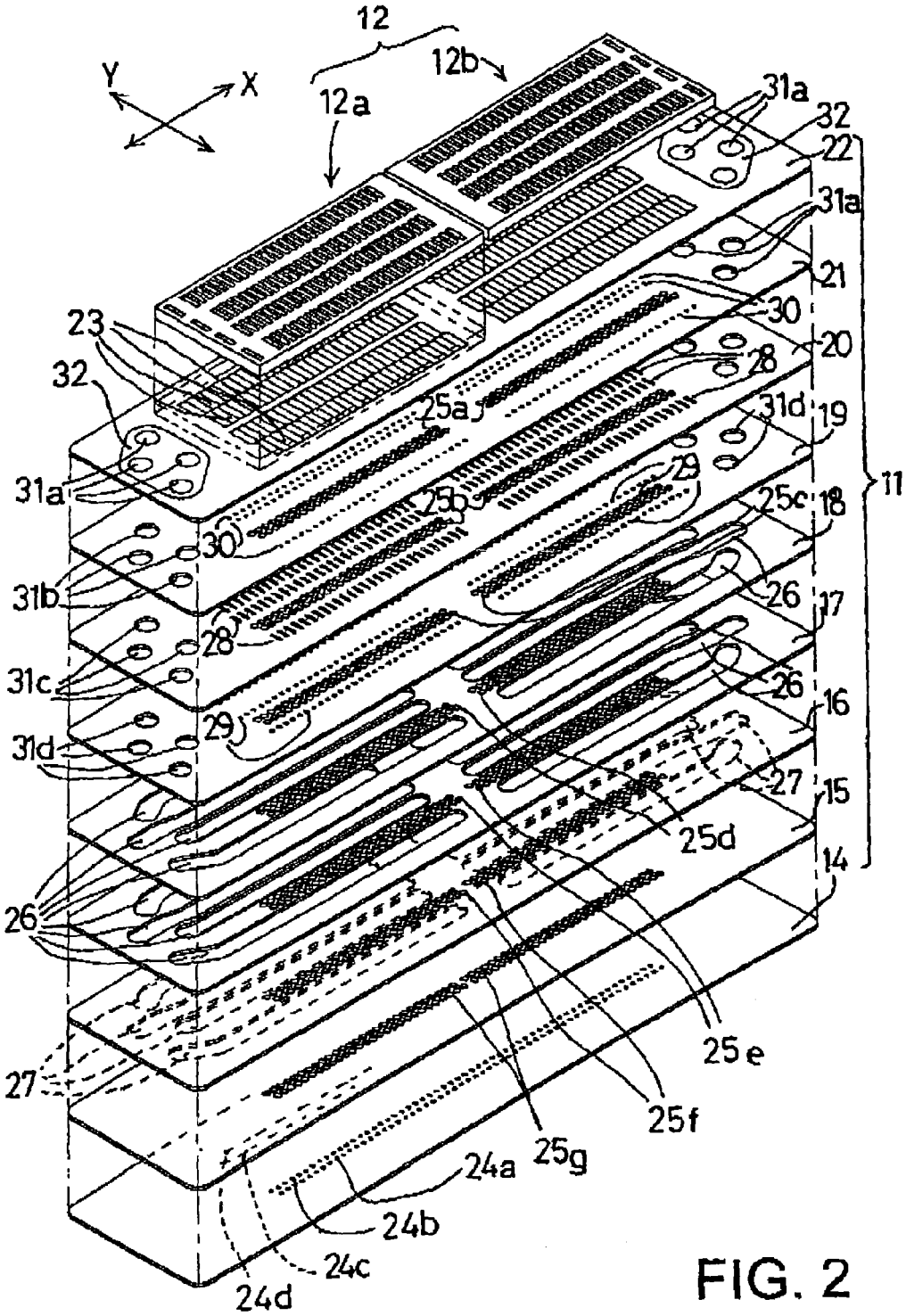
FIG. 2 is a perspective explosive view of the cavity unit.

The pressure chambers 23 correspond to the respective nozzles 24 arranged in the four rows. Each piezoelectric actuator unit 12*a*, 12*b* is arranged to activate the pressure chambers 23 corresponding to the nozzles 24 in a half of the length of each of the four rows, that is, 75 pressure chambers 23. Namely, the first piezoelectric actuator unit 12*a* is formed on the first half of the upper surface of the cavity unit 11 as seen in the longitudinal direction (in the first direction described above), while the second piezoelectric actuator unit 12*b* is formed on the other or second half of the upper surface, as shown in FIGS. 2 and 6A.

As described below in greater detail, each piezoelectric actuator unit 12*a*, 12*b* consists of a laminar structure consisting of piezoelectric sheets 33, 34 and a top sheet 35 (which will be described) superposed on each other, such that the piezoelectric sheets 33 having individual electrodes 36 formed thereon and the piezoelectric sheets 34 having common electrodes 37 formed thereon are alternately laminated. The piezoelectric sheets 33, 34 have the above-indicated active portions between the individual electrodes 36 and the common electrodes 37. Upon application of a voltage between the selected individual electrodes 36 and the common electrodes 37, the active portions corresponding to the selected individual electrodes 36 are strained due to a longitudinal piezoelectric effect in the direction of lamination of the piezoelectric actuator unit 12*a*, 12*b*. The active portions are arranged in four rows corresponding to the respective four rows of the pressure chambers 23, and the active portions of each row correspond to the respective pressure chambers 23 of the corresponding row.

That is, the four rows of the active portions of each piezoelectric actuator unit 12*a*, 12*b* are parallel to the four rows of the nozzles 24 (pressure chambers 23) extending in the first direction, and are spaced apart from each other in the second direction. Each active portion is elongate in the above-indicated second direction (direction of width of the cavity unit 11), which is the longitudinal direction of each pressure chamber 23. The active portions have the same spacing pitch P as the pressure chambers 23 in the longitudinal direction of the cavity unit 11, such that the active portions of the four rows are arranged in a zigzag pattern, as is apparent from FIG. 4.

The pressure chambers 23 are arranged in two groups which correspond to the respective two piezoelectric actuator units 12*a*, 12*b* and which are arranged and spaced apart from each other in the longitudinal direction of the base plate 22. Namely, the pressure chambers 23 of the first group corresponding to the first piezoelectric actuator unit 12*a* correspond to the nozzles 24 in the first half of each row as seen in the direction of extension of the row (in the first direction), while the pressure chambers 23 of the second group corresponding to the second piezoelectric actuator unit 12*b* correspond to the nozzles 24 in the second half of each row. The pressure chambers 23 of each group are arranged in four rows, with the same spacing pitch P as the nozzles 24, such that the pressure chambers 23 in the first and second rows are positioned relative to each other in a zigzag pattern, while the pressure chambers 23 in the third and fourth rows are similarly positioned relative to each other in a zigzag pattern.

Each of the pressure chambers 23 is elongate in the direction of width of the base plate 22 (in the second direction), and is formed through the thickness of the base plate 22. Each of the pressure chambers 23 is held in communication at one of its opposite longitudinal ends with the corresponding nozzle 24 through a corresponding one of communication passages 25 defined by through-holes 25*a*, 25*b*, 25*c*, 25*d*, 25*e*, 25*f* and 25*g* which are respectively formed through the spacer plates 21, 20, 19, manifold plates 18, 17, damper plate 16 and intermediate plate 15, which are located between the base plate 22 and the nozzle plate 14. Each pressure chamber 23 is held in communication at the other longitudinal end with a manifold portion 26 partially defined by the manifold plates 27, 28.

As shown in FIGS. 2 and 5, the two groups of pressure chambers 23 are spaced apart from each other by a distance L2 larger than the spacing pitch P of the pressure chambers 23, in the longitudinal direction of the base plate 22. This spacing of the two groups of pressure chambers 23 is provided because it is difficult to fabricate the piezoelectric actuator units 12*a*, 12*b* such that a distance L1 between the individual electrodes 36 at one end of each row and the adjacent end of the piezoelectric actuator unit 12*a*, 12*b* is equal to or smaller than a half of the spacing pitch P of the individual electrodes 36. In view of this difficulty, the piezoelectric actuator units 12*a*, 12*b* are fabricated with the distance L1 being larger than the half of the spacing pitch P, and with the spacing distance L2 being larger than the distance L1, such that the longitudinal end faces of the two piezoelectric actuator units 12*a*, 12*b* which are opposed to each other are spaced from each other by a suitable distance (L2−2×L1).

Thus, the two groups of pressure chambers 23 are spaced apart from each other in the longitudinal direction of the base plate 22, while the nozzles 24 are equally spaced apart from each other at the predetermined spacing pitch P in the direction of extension of the rows of the nozzles 24, so that the communication passages 25 for communication of each pressure chamber 23 at its one end with the corresponding nozzle 24 are inclined with respect to the direction of lamination of the plates 15–21 of the cavity unit 11, as shown in FIG. 5. The communication passages 25 corresponding to the two groups of pressure chambers 23 are inclined symmetrically with each other, with respect to a plane which is parallel to the above-indicated direction of lamination and which passes a midpoint of the spacing distance L2 of the two groups, as also shown in FIG. 5.

Figure 3:
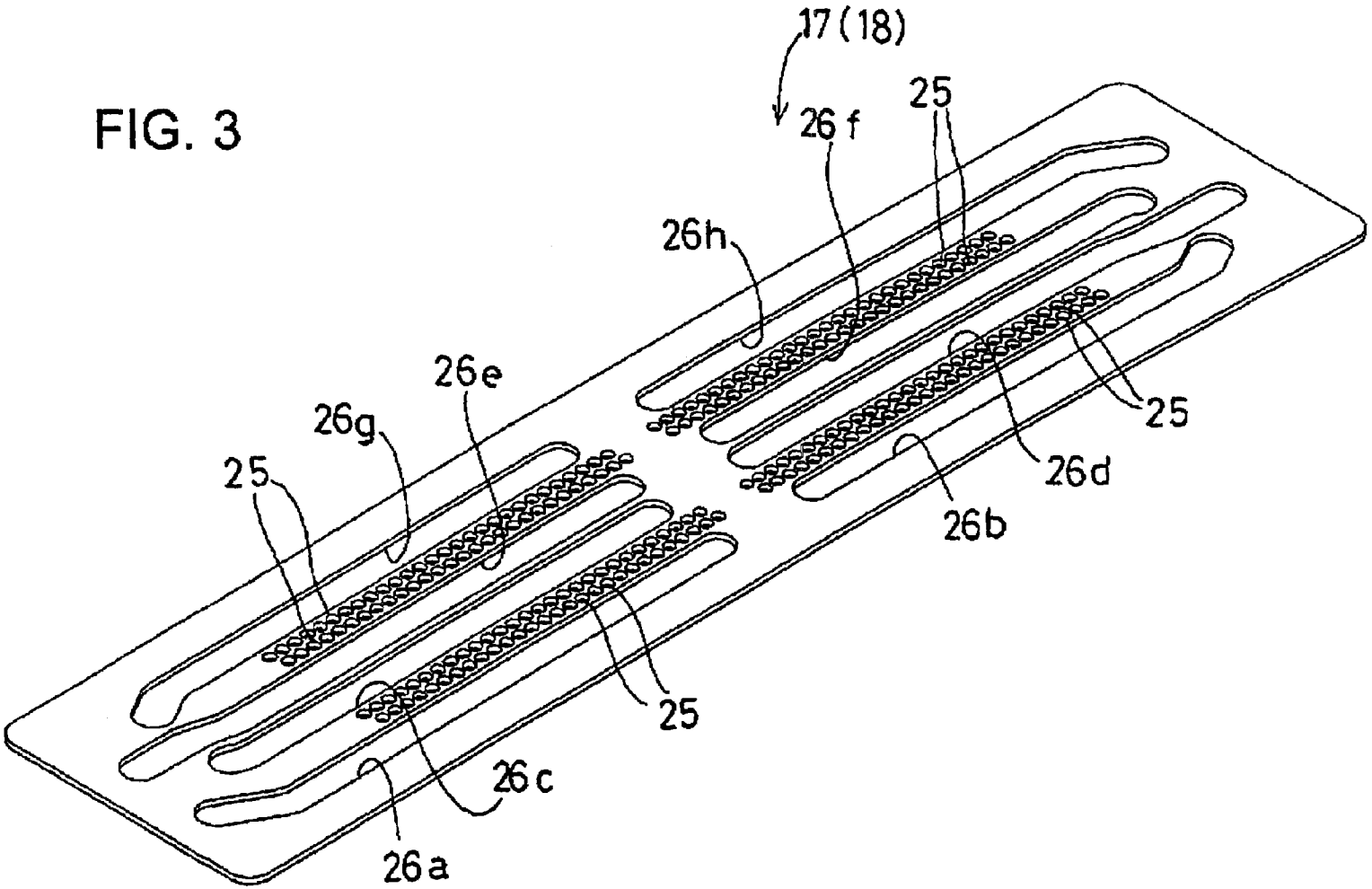
FIG. 3 is a perspective view of a manifold plate of the cavity unit.

The above-indicated two manifold plates 17, 18 partially define the manifold portion 26 in the form of mutually independent eight elongate manifold chambers 26*a*, 26*b*, 26*c*, 26*d*, 26*e*, 26*f*, 26*g* and 26*h*, all of which extend in parallel with the rows of the nozzles 24 described above, as shown in FIG. 3. In other words, the manifold portion 26 has a plurality of divisions. Described in greater detail, each of the eight manifold chambers 26*a*–26*h* has a length corresponding to a fraction of the entire length of each row of the nozzles 24, more specifically, has a length which covers the length of each group of the pressure chambers 23 (the 75 pressure chambers 23 in each of the four rows of each group). That is, the cavity unit 11 has a first group of mutually independent four manifold chambers 26*a*, 26*c*, 26*e* and 26*g* corresponding to the respective four rows of the pressure chambers 23 of one of the two groups, and a second group of mutually independent four manifold chambers 26*b*, 26*d*, 26*f* and 26*h* corresponding to the respective four rows of the pressure chambers 23 of the other group, as indicated in FIGS. 2 and 3. Each of the elongate manifold chambers 26*a*–26*h* of each group has a longitudinal end portion extending in a direction away from the other group, for communication with a corresponding one of ink supply passages 31 connected to an external ink supply source (not shown). The other longitudinal end portion of each of the manifold chambers 26*a*, 26*c*, 26*e* and 26*g* of the first group is located near that of each of the manifold chambers 26*b*, 26*d*, 26*f* and 26*h* of the second group. Each manifold chamber 26*a*–26*h* is formed through the entire thickness of each manifold plates 17, 18, by laser machining, plasma jet machining or electrolytic etching, and is fluid-tightly closed at its upper and lower ends (as seen in FIG. 2) by the first spacer plate 19 superposed on the manifold plate 18 and the damper plate 16 underlying the manifold plate 17. The damper plate 16 has damper chambers 27 in the form of grooves formed in its lower surface by etching through a portion of its thickness. These damper chambers 27 have the same shape as the manifold chambers 26*a*–26*h* as viewed in the plane of the damper plate 16.

The reverse component of the pressure wave of the ink mass in each pressure chamber 23 generated upon operation of the piezoelectric actuator 12 is absorbed by an oscillating motion of a relatively thin bottom wall of the damper chamber 27 formed in the damper plate 16, so that a cross talk which would otherwise occur between the adjacent pressure chambers 23 can be prevented.

Figure 6B:
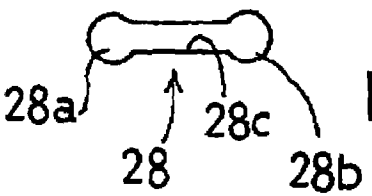
FIG. 6B is an enlarged plan view of a flow restrictor formed in the cavity unit.

The second spacer plate 20 partially defines flow restrictors 28 formed in alignment with the respective pressure chambers 23. Each of these flow restrictors 28 has a shape as shown in FIG. 6B, as seen in the plane of the second spacer plate 20. That is, each flow restrictor 28 has a large area of ink flow at its longitudinal opposite end portions 28*a*, 28*b*, and a comparatively small area of ink flow at its intermediate portion 28*c*. Each flow restrictor 28 is elongate in the longitudinal direction of the corresponding pressure chamber 23. The flow restrictors 28 are fluid-tightly closed at their lower end by the first spacer plate 19 underlying the second spacer plate 20, and at their upper end by the third spacer plate 21 superposed on the second spacer plate 20. The first spacer plate 19 has first ink passages 29 communicating with the manifold chambers 26*a*–26*h* and one longitudinal end portion 28*a* of each flow restrictor 28, while the third spacer plate 21 has second ink passages 30 communicating with the other longitudinal end portion 28*b* of each flow restrictor 28 and the corresponding end portion of each pressure chamber 23.

As shown in FIG. 2, the base plate 22, and the third, second and first spacer plates 21, 20, 19 have respective ink supply holes 31*a*, 31*b*, 31*c*, 31*c* of a relatively large diameter formed through their opposite longitudinal end portions. These ink supply holes 31*a*–31*d* cooperate to define the above-indicated ink supply passages 31, more precisely, four ink supply passages 31 in one longitudinal end-portion of the cavity unit 11, and four ink supply passages 31 in the other longitudinal end portion of the cavity unit 11. These eight ink supply passages 31 are held in communication with the above-indicated one end portion of each manifold chamber 26*a*–26*h* of each group. Two filters 32 are provided to cover the upper surfaces of the opposite longitudinal end portions of the base plate 22 in which the ink supply holes 31*a* are open. The filters 32 are provided to remove dirt or any other foreign matters that may be contained in the ink supplied from the ink supply source such as an ink reservoir.

Figure 4:
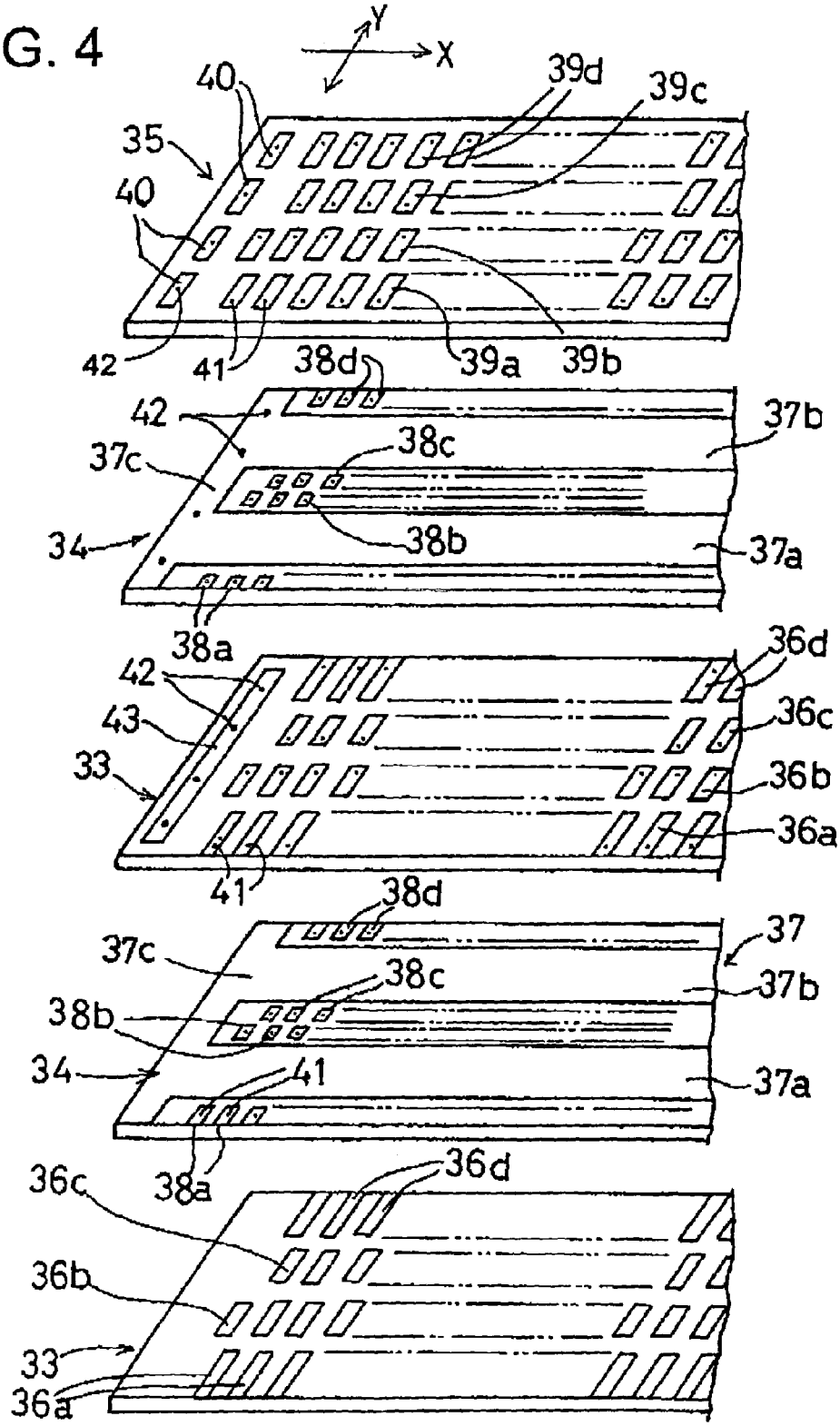
FIG. 4 is a fragmentary enlarged perspective view showing patterns of arrangement of individual electrodes and common electrodes of the piezoelectric actuator.

On the other hand, each of the two piezoelectric actuator units 12*a*, 12*b* which are two divisions of the actuator 12 is a laminar structure consisting of the above-indicated piezoelectric sheets 33, 34 and top sheet 35 superposed on each other, as shown in FIG. 4 and as briefly described above. Although only two piezoelectric sheets 33 and only two piezoelectric sheets 34 are shown in FIG. 4, the laminar structure may include a total of four to ten piezoelectric sheets 33, 34 alternately superposed on each other. Each of these piezoelectric sheets 33, 34 and top sheet 35 has a thickness of about 30 $\mu$m. As shown in FIG. 4, each of the piezoelectric sheets 33 has the individual electrodes 36 in the form of elongate strips which are aligned with the respective pressure chambers 23 of the cavity unit 11 and which are arranged in four rows (36*a*, 36*b*, 36*c*, 36*d*) parallel to the first direction (longitudinal direction of the piezoelectric sheets 33), which is parallel to the X-axis direction as indicated in FIG. 4 or the direction of extension of the rows of the nozzles 24*a*–24*d*.

Each of the individual electrodes 36*a*, 36*b*, 36*c*, 36*d* in the four rows is elongate in the second direction (Y-axis direction), that is, in the direction of width of the piezoelectric sheets 33, and has a length substantially equal to that of each pressure chamber 23*a*, 23*b*, 23*c*, 23*d*. However, the width of the individual electrode 36*a*–36*d* is slightly smaller than that of each pressure chamber 23. The first row of individual electrodes 36*a* and the fourth row of individual electrodes 36*d* are located near the respective opposite long side edges of the corresponding piezoelectric sheet 33.

On the other hand, the second row of individual electrodes 36*b* and the third row of individual electrodes 36*c* are located in a widthwise central portion of the corresponding piezoelectric sheet 33, between the first and fourth rows of individual electrodes 36*a*, 36*d* located adjacent to the opposite long side edges of the piezoelectric sheet 33. Each of the piezoelectric sheets 33 except the lowermost one has a dummy common electrode 43 aligned with a lead portion 37*c* of the common electrode 37 which will be described.

The common electrode 37 formed on the upper surface of each piezoelectric sheet 34 includes two main portions 37*a*, 37*b* which are elongate in the above-indicated first direction of the cavity unit 11 (in the X-axis direction or the longitudinal direction of the piezoelectric sheet 34), and the above-indicated lead portion 37*c* which is connected to the main portions 37*a*, 37*b* and which extends along one of the opposite short side edges of the piezoelectric sheet 34. The first main portion 37*a* is located in alignment with an almost entire portion of each individual electrode 36*a* in the first row and an almost entire portion of each individual electrode 36*b* in the second row, as viewed in the plane of the piezoelectric sheet 34. Each piezoelectric sheet 34 further has dummy electrodes 38*a*, 38*b* arranged in two rows located on the respective opposite sides of the first main portion 37*a* such that these dummy electrodes 38*a*, 38*b* in each row are equally spaced apart from each other at the predetermined spacing pitch, and such that each dummy electrode 38*a*, 38*b* is aligned with only a portion of the corresponding individual electrode 36*a*, 36*b* in the first and second rows, as viewed in the plane of the piezoelectric sheet 34.

Similarly, the second main portion 37*b* is located in alignment with an almost entire portion of each individual electrode 36*c* in the third row and an almost entire portion of each individual electrode 36*d* in the fourth row, as viewed in the plane of the piezoelectric sheet 34. Each piezoelectric sheet 34 further has dummy electrodes 38*c*, 38*d* arranged in two rows located on the respective opposite sides of the second main portion 37*b* such that these dummy electrodes 38*c*, 38*d* in each row are equally spaced apart from each other at the predetermined spacing pitch, and such that each dummy electrode 38*c*, 38*d* is aligned with only a portion of the corresponding individual electrode 36*c*, 36*d* in the third and fourth rows, as viewed in the plane of the piezoelectric sheet 34.

On the upper surface of the top sheet 35, there are formed four rows of surface electrodes 39*a*, 39*b*, 39*c*, 39*d* aligned with the respective four rows of the individual electrodes 36*a*, 36*b*, 36*c*, 36*d*, and four surface electrodes 40 aligned with the main portions 37*a*, 37*b* of the common electrodes 37 in the first direction. The piezoelectric sheets 33, 34 and top sheet 35 which are superposed on the lowermost piezoelectric sheet 33 have through-holes 41 formed through their thickness, and through the surface electrodes 39*a*, 39*b*, 39*c*, 39*d*, the individual electrodes 36*a*, 36*b*, 36*c*, 36*d* and the dummy electrodes 38*a*, 38*b*, 38*c*, 38*d*. These through-holes 41 are filled with an electrically conductive material (formed from an electrically conductive paste), for electrically connecting the surface electrodes 39*a*–39*d* with the individual electrodes 36*a*–36*d* and dummy electrodes 38*a*–38*d*. The above-indicated piezoelectric sheets 33, 34 and top sheet 35 further have through-holes 42 formed through their thickness and through the surface electrodes 40 on the top sheet 35, the lead portion 37*c* of the common electrode 37 on each piezoelectric sheet 34 and a dummy common electrode 43 formed on the upper piezoelectric sheet 33. These through-holes 42 are also filled with an electrically conductive material (electrically conductive paste), for electrically connecting the surface electrodes 40 with the lead portions 37*c* and the dummy common electrode 43.

To fabricate each piezoelectric actuator unit 12*a,* 12*b* of the piezoelectric actuator 12, unfired layers which give_the individual electrodes 36, common electrodes 37, dummy electrodes 38, dummy common electrode 43, and surface electrodes 39, 40 are formed by screen printing using a suitable electrically conductive paste such as a paste of silver and palladium, on the surfaces of ceramic substrates which give the piezoelectric ceramic sheets 33, 34 and top sheet 35. After those layers are dried, the ceramic substrates are laminated on each other and fired into the piezoelectric sheets 33, 34 and top sheet 35 having the various electrodes indicated above. Obviously, the dummy electrodes 38*a,* 38*b,* 38*c,* 38*d* are formed at respective local spots, so as to avoid electrical continuity with each other and with the common electrodes 37, and the dummy common electrode 43 is formed at a local spot, so as to avoid electrical continuity with the individual electrodes 36.

Then, the lower surfaces of the two actuator units 12*a,* 12*b* of the piezoelectric actuator 12 thus constructed are entirely covered by respective layers or sheets (not shown) of an adhesive agent in the form of an ink impermeable synthetic resin, and the two actuator units 12*a,* 12*b* are bonded at those sheets of the adhesive agent to the upper surface of the cavity unit 11 such that the individual electrodes 36*a*–36*d* are aligned with the respective pressure chambers 23 formed in the cavity unit 11, as shown in FIGS. 5 and 6A. Further, the flexible flat cable 13 is pressed onto the upper surface of each actuator unit 12*a,* 12*b,* such that electrically conductive wires (not shown) of the flexible flat cables 13 are electrically connected to the surface electrodes 39, 40.

Then, a predetermined high voltage is applied between all of the individual electrodes 36 and the common electrodes 37 through the surface electrodes 39, 40, for polarizing local portions of the piezoelectric sheets 33, 34 which are sandwiched between the respective individual electrodes 36 and the common electrodes 37. The thus polarized portions of the piezoelectric sheets 33, 34 function as the active portions of the actuator 12. In operation of the ink-jet printing head 10, an ink-jetting drive voltage is applied between the selected individual electrodes 36 and the common electrodes 37, through the surface electrodes 39, 40, to produce electric fields in the corresponding active portions, in the direction of polarization, so that the active portions are elongated in the direction of lamination of the piezoelectric sheets 34, 35, whereby the volumes of the corresponding pressure chambers 23*a*–23*d* are reduced. As a result, the ink masses in the pressure chambers 23*a*–23*d* are jetted as droplets from the corresponding nozzles 24*a*–24*d,* onto a recording medium, as indicated in FIG. 6A, so that an image in the form of ink dots is printed on the recording medium.

Where a full-color printing operation is performed by the present ink-jet printing head 10, using inks of four colors (black, cyan, yellow and magenta), the first, second, third and fourth rows of nozzles 24*a,* 24*b,* 24*c* and 24*d* are respectively used for delivering the black, cyan, yellow and magenta inks, for example. In this case, the first manifold chambers 26*a,* 26*b* of the respective two groups formed in the manifold plates 17, 18 are filled with the black ink, and the second manifold chambers 26*c,* 26*d* are filled with the cyan ink. The third manifold chambers 26*e,* 26*f* are filled with the yellow ink, and the fourth manifold chambers 26*g,* 26*h* are filled with the magenta ink.

In the present ink-jet printing head 10, the manifold portion 26 has the two groups of mutually independent manifold chambers 26*a,* 26*c,* 26*e* and 26*g,* and 26*b,* 26*d,* 26*f* and 26*h* as shown in FIG. 3, each of which has the same length, the same depth and the same shape in the plane of the manifold plates 17, 18, as each of the manifold chambers of a cavity unit of an already developed or existing ink-jet printing head wherein the 75 nozzles (75 pressure chambers) are equally spaced apart from each other in each row extending in the longitudinal direction over a length of one inch. Namely, each of the manifold chambers 26*a*–26*h* has a length corresponding to a half of the number (150) of the pressure chambers 23 arranged over a length of two inches along a straight line parallel to the longitudinal direction of the cavity unit 11, that is, a length corresponding to the 75 pressure chambers 23 arranged over a length of one inch. In addition, the actuator unit 12 of the present ink-jet printing head 10 consists of the two piezoelectric actuator its 12*a,* 12*b* each of which is the same as an already developed or existing piezoelectric actuator arranged to operate the 75 pressure chambers arranged in each of the four rows and which are arranged in a spaced-apart relationship with each other in the longitudinal direction of the cavity unit 11. This design concept of the manifold portion 26 and the piezoelectric actuator 12 prevents a reduction in the rate or amount of flow or supply of the ink due to a resistance to a flow of the ink through the manifold portion 26, and permits all of the pressure chambers 23 to be operated with the nominal drive voltage and at the nominal timing by the piezoelectric actuator 12, assuring adequate jetting of droplets of the ink from all of the nozzles 24 as in the prior art ink-jet printing head, even where the number of the nozzles is considerably larger in the present ink-jet printing head 10.

According to the present invention, the length of the manifold chambers is not increased with an increase in the number of the nozzles (with an increase in the length of each row of the nozzles), but the number of the manifold chambers corresponding to each row of the nozzles is determined or increased depending upon the number of the nozzles. Accordingly, an increase in the number of the nozzles in each row will not undesirably increase a resistance to the ink flow through the manifold portion (through each manifold chamber), which would reduce the rate or amount of supply or delivery of the ink to some of the nozzles. While the flow resistance of the ink can be reduced by increasing the width and/or depth of each manifold chamber, this solution not only results in an increase in the size of the cavity unit 11, but also requires re-designing of the nominal drive voltage, timing and waveform of the piezoelectric actuator 12, so as to prevent a cross talk between the adjacent pressure chambers 23 due to the pressure wave component of the ink propagating from the pressure chambers 23 to the manifold portion 26. In the present embodiment, however, each of the two groups of manifold chambers 26*a*–26*h* of the manifold portion 26 which correspond to the respective two groups of pressure chambers 23 are identical in design with the manifold chambers of the manifold portion of the existing printing head. Accordingly, the piezoelectric actuator 12 of the present printing head can be operated to deliver the ink from the nozzles 24 in the same manner as in the existing printing head, by operating the piezoelectric actuator 12 with the same voltage, timing and waveform as in the existing printing head.

Although the manifold portion 26 has the two groups of manifold chambers 26*a*–26*h* arranged in the longitudinal direction of the cavity unit 11 while the piezoelectric actuator 12 consists of the two actuator units 12*a*, 12*b* also arranged in the longitudinal direction, the manifold portion 26 and the piezoelectric actuator 12 may be modified to have three or more groups of manifold chambers or consists of three or more piezoelectric actuator units.

Thus, the present invention permits easy, economical and efficient development and manufacture of an ink-jet printing head having desired printing capability and operating accuracy (desired density of the nozzles or ink dots per inch), by utilizing a plurality of piezoelectric actuators of an existing type, and by adopting the same design (length, depth and shape in the plane of the manifold plates) of the manifold portion of the cavity unit of an existing type, even where each row of nozzles or pressure chambers in the printing head is considerably long.

In the present embodiment, the pressure chambers 23 consist of two groups arranged in the direction of extension of the rows of the nozzles 24 such that the two groups are spaced apart from each other by the relatively large spacing distance L2, while the nozzles 24 are equally spaced apart from each other at the predetermined relatively small pitch P (<L2), and the communication passages 24 for communication between the pressure chambers 23 and the corresponding nozzles 24 are inclined. Although the present ink-jet printing head 10 has a larger number of nozzles 24 than in an existing printing head having a smaller number of nozzles in each row and the same spacing pitch of the nozzles as in the present printing head, the piezoelectric actuator of the existing print head which has a smaller length in the direction of extension of the rows of the nozzles can be used as each of the two piezoelectric actuator units 12*a*, 12*b* of the piezoelectric actuator 12 of the present printing head 10, which are arranged in the direction of extension of the rows of the nozzles 24. Accordingly, each of the two piezoelectric actuator units 12*a*, 12*b* has a reduced amount of shrinkage due to firing of the actuator units, making it possible to reduce a variation in the spacing distance between the adjacent active portions, thereby permitting efficient manufacture of the piezoelectric actuator having a high degree of dimensional accuracy.

Where the existing ink-jet printing head has 75 nozzles (pressure chambers) arranged in each row in the longitudinal direction over a length of one inch, a desired ink-jet printing head wherein the length of each row of the nozzles is two or more inches can be efficiently fabricated by using a plurality of piezoelectric actuators of the existing ink-jet printing head.

In the present embodiment, the two piezoelectric actuator units 12*a*, 12*b* are arranged in a spaced-apart relationship with each other in the direction of extension of the rows of the nozzles 24, such that the opposed end faces of the two piezoelectric actuator units 12*a*, 12*b* are spaced apart from each other by a certain distance of gap (L2–2×L1). However, this distance of gap may be almost zeroed.

It is to be understood that the number of the pressure chambers 23 (nozzles 24) and the number of the actuator units of the piezoelectric actuator 12, which correspond to the length of each manifold chamber 26*a*–26*h*, are not particularly limited, but may be determined as needed.

In the cavity unit 11 of present embodiment, the four manifold chambers 26*a*, 26*c*, 36*e*, 26*g* (26*b*, 26*d*, 26*f*, 26*h*) of each of the two groups are formed in substantial alignment with the respective four rows of the nozzles 24, such that each manifold chamber extends in a direction substantially parallel to the direction of extension of the rows of the nozzles 24, so that the cavity unit 11 can be made relatively compact with a relatively small surface area as viewed in its plane.

In the illustrated embodiment, the 150 nozzles 24 arranged in each of the four rows are held in communication with one pair of two rows of the pressure chambers 23 which lie on the same straight line parallel to the direction of the rows of the nozzles 24. Where the piezoelectric actuator 12 has two sets of the first and second actuator units 12*a*, 12*b* which are arranged in the Y-axis direction, while the cavity unit 11 has two groups (first and second groups) of pressure chambers 23 which are arranged in the X-axis direction and each of which consists of eight rows of pressure chambers 23 corresponding to the respective eight rows of the individual electrodes 36 of the corresponding two first or second actuator units 12*a*, 12*b*, the cavity unit may be provided with four rows of nozzles 24 which are formed such that 300 nozzles 24 are arranged in each of the four rows over a length of two inches and are held in communication with the four rows of pressure chambers 23 consisting of the two rows of the first group and the corresponding two rows of the second group. This modification provides a large-sized full-color ink-jet printing head, wherein the four rows of the nozzles 24 are assigned to the respective four colors, and are capable of printing a high-density image (150 dpi) having a maximum dimension of two inches in the secondary scanning direction (direction of feeding of the recording medium). Thus, the number of the rows of the active portions and the pressure chambers may be a multiple of the number of rows of the nozzles, so that the density of the nozzles in the direction of extension of the rows is a multiple of the density of the active portions and pressure chambers in the direction of extension of the rows.

In the illustrated embodiment, the ink-jet printing head 10 has the four rows of nozzles. However, the principle of the present invention is equally applicable to an ink-jet printing head having at least one row of nozzles. Further, the actuator used for the ink-jet printing head is not limited to the piezoelectric actuator 12 utilizing piezoelectric elements. However, the actuator may include oscillating plates which define the bottom walls of the pressure chambers and which are oscillated by static electricity to deliver the ink, or include Joule-heat generating elements operable according to a drive signal to generate heat for vaporizing the ink masses within the pressure chambers, for pressurizing the ink to be delivered from the nozzles.

What is claimed is:

1. An ink-jet printing head comprising a cavity unit and an actuator which are superposed on each other, said cavity unit having (a) a plurality of nozzles open in a front surface thereof and arranged in at least one row such that said nozzles are spaced apart from each other with a predetermined spacing pitch in a direction of extension of said at least one row, (b) a plurality of pressure chambers which respectively correspond to said nozzles and which are spaced apart from each other with said predetermined spacing pitch in said direction of extension, and (c) a plurality of communication passages for communication between the respective pressure chambers and the respective nozzles, said actuator having a plurality of active portions which correspond to said plurality of pressure chambers, respectively, and which are operable to deliver the ink from the corresponding nozzles, wherein said plurality of active portions of said actuator are arranged in said direction of extension, with said predetermined spacing pitch except in a local portion of a length of said actuator in said direction of extension in which a spacing distance between two adjacent ones of said active portions in said direction of extension is larger than said predetermined spacing pitch, said plurality of pressure chambers including two groups of pressure chambers located on respective opposite sides of said local portion of the length of the actuator; and said plurality of communication passages include two groups of communication passages for communication of said first and second groups of pressure chambers with respective two groups of said nozzles of each of said at least one row, said communication passages of one of said two groups and the communication passages of the other of said two groups are inclined with respect to said front surface of said cavity unit, symmetrically with each other with respect to a plane which is perpendicular to said front surface and which includes a midpoint of said local portion of the length of said actuator in said direction of extension.

2. An ink-jet printing head according to claim 1, wherein said plurality of active portions of said actuator include two groups of active portions respectively corresponding to said two groups of pressure chambers, and said actuator comprises a plurality of mutually independent actuator units which include said two groups of said plurality of active portions, respectively.

3. An ink-jet printing head according to claim 2, wherein said cavity unit further has (d) a manifold portion for storing an ink supplied from an ink supply source and re-filling said plurality of pressure chambers, said manifold portion comprising a plurality of mutually independent divisions respectively having a plurality of mutually independent manifold chambers which correspond to said respective length portions of said each row of said nozzles.

4. An ink-jet printing head including a cavity unit and an actuator which are superposed on each other, said cavity unit having (a) a plurality of nozzles open in a front surface thereof and arranged in at least one row, (b) a plurality of pressure chambers respectively corresponding to said plurality of nozzles and arranged in at least one row corresponding to said at least one row of said plurality of nozzles, and (c) a plurality of communication passages for communication between the respective pressure chambers and the respective nozzles, said actuator having a plurality of active portions which respectively correspond to said plurality of pressure chambers and which are selectively operable to deliver an ink from the corresponding nozzles, said plurality of nozzles in each of said at least one row being spaced apart from each other with a predetermined spacing pitch in a direction of extension of said at least one row, and including a plurality of groups of nozzles which are arranged in said direction of extension of said at least one row, each of said plurality of groups of nozzles including a plurality of nozzles adjacent to each other, said plurality of pressure chambers in each of said at least one row including a plurality of groups of pressure chambers respectively corresponding to said plurality of groups of nozzles, each of said plurality of groups of pressure chambers including a plurality of chambers adjacent to each other, said plurality of groups of pressure chambers being arranged such that a spacing distance between two adjacent ones of said plurality of pressure chambers, which respectively belong to two adjacent ones of said plurality of groups of pressure chambers, is larger than said predetermined spacing pitch of said plurality of nozzles, and wherein the communication passages corresponding to said plurality of nozzles of each of at least one of said plurality of groups of nozzles are inclined with respect to at least said direction of extension of said at least one row of said plurality of nozzles.

5. An ink-jet printing head according to claim 4, wherein said plurality of chambers of each of said plurality of groups of pressure chambers are spaced apart from each other with a spacing pitch equal to said predetermined spacing pitch of said plurality of nozzles.

6. An ink-jet printing head according to claim 4, wherein said actuator includes a plurality of actuator units which are separate from each other and which respectively correspond to said plurality of groups of pressure chambers, each of said plurality of actuator units having a plurality of active portions corresponding to the respective pressure chambers.

7. An ink-jet printing head according to claim 6, wherein said plurality of actuator units are arranged in said direction of extension of said at least one row of said plurality of nozzles, such that end faces of adjacent ones of said plurality of actuator units are opposed to each other in said direction of extension.

8. An ink-jet printing head according to claim 7, wherein said end faces of said adjacent ones of said plurality of actuator units are spaced apart from each other.

9. An ink-jet printing head according to claim 4, wherein said plurality of groups of nozzles includes two groups of nozzles, and said plurality of pressure chambers includes two groups of pressure chambers, the communication passages corresponding to one of said two groups of nozzles and the communication passages corresponding to the other of said two groups of nozzles are inclined in respective opposite directions with respect to said direction of extension of said at least one row of said plurality of nozzles.

10. An ink-jet printing head according to claim 4, wherein said plurality of nozzles are arranged in four rows.

11. An ink-jet printing head according to claim 10, wherein said four rows of said plurality of nozzles correspond to respective four colors of the ink.

12. An ink-jet printing head according to claim 4, wherein said cavity unit has a manifold portion for storing an ink supplied from an ink supply source and re-filling said plurality of pressure chambers, said manifold portion having a plurality of manifold chambers which respectively correspond to said plurality of groups of pressure chambers.

* * * * *